US005484010A

United States Patent [19]

Rouzeval et al.

[11] Patent Number: 5,484,010

[45] Date of Patent: Jan. 16, 1996

[54] DEVICE FOR GUIDING A CAST BAR FROM THE OUTPUT OF A CASTING WHEEL TO THE INPUT OF A ROLLING MILL

[75] Inventors: André Rouzeval, Conflans-Ste-Honorine; Christian Viel, Houilles, both of France

[73] Assignee: Clecim, Cergy Pontoise, France

[21] Appl. No.: 137,421

[22] Filed: Oct. 18, 1993

[30] Foreign Application Priority Data

Oct. 26, 1992 [FR] France ..... 92 12755

[51] Int. Cl.[6] ..... B22D 11/06; B22D 11/128

[52] U.S. Cl. ..... 164/433; 164/442

[58] Field of Search ..... 164/433, 434, 164/441, 442, 447, 448

[56] References Cited

U.S. PATENT DOCUMENTS

| | | | |
|---|---|---|---|
| 3,296,682 | 1/1967 | Cofer et al. | 164/433 X |
| 3,351,126 | 11/1967 | Richards et al. | 164/433 |
| 3,735,802 | 5/1973 | Chia et al. | 164/433 |
| 4,064,929 | 12/1977 | Quehen et al. | 164/433 |
| 4,290,478 | 9/1981 | Kagerhuber et al. | 164/442 X |

FOREIGN PATENT DOCUMENTS

| | | | |
|---|---|---|---|
| 0066524 | 12/1982 | European Pat. Off. | 164/433 |
| 0450391 | 10/1991 | European Pat. Off. | 164/442 |
| 56-68561 | 6/1981 | Japan | 164/442 |
| 3-258444 | 11/1991 | Japan | 164/448 |
| 954158 | 9/1982 | U.S.S.R. | 164/433 |

*Primary Examiner*—J. Reed Batten, Jr.
*Attorney, Agent, or Firm*—Pollock, Vande Sande & Priddy

[57] ABSTRACT

The device includes a series of fixed and mobile guide tables that guide and progressively bend the strand.

6 Claims, 3 Drawing Sheets

DEVICE FOR GUIDING A CAST BAR FROM THE OUTPUT OF A CASTING WHEEL TO THE INPUT OF A ROLLING MILL

BACKGROUND OF THE INVENTION

1. Field of the Invention

This invention relates to a device for guiding a continuously cast bar (called a strand) from the point it emerges from a casting wheel in which it has been cast, up to the point it enters an installation for processing the strand.

2. Background Information

Wheel type strand continous casting machines traditionally comprise a casting wheel having a trapezoidal or triangular shaped grooved periphery, a metal strip being applied to a section of the periphery so as to form a rotary mold.

The metal strip, produced in the form of an endless belt, is wound around return, pressure and tension pulleys which allow the metal strip to be applied to the portion of the wheel periphery forming the mold.

A feed chute supplying molten metal is arranged at one of the points where the metal strip breaks contact with the casting wheel.

Spraying booms are arranged in front of the metal strip around the wheel periphery allowing the rotary mold thus formed to be cooled.

A device in the form of a knife, called an extractor, is installed at the other point where the metal strip breaks contact with the casting wheel in order to take off the solidified metal strand from the wheel.

The form of this strand produced continuously by the casting machine, is identical to that of the casting wheel groove, save for shrinkage due to the cooling of the metal.

The strand so cast is thereafter directed to a processing installation comprising, for example, a rolling mill associated with tensioning devices and other elements.

In particular, when casting begins, the tip of the strand must pass into an automatic or non-automatic shearing machine located upstream of the processing installation and in order to eliminate through cutting into pieces of short lengths all that part of the strand whose metallurgical quality has not reached the level required to undergo the rolling transformations.

The automatic shearing device generally consists of a set of rollers-pinchers whose upper roller, or rollers, withdraw sideways to allow the strand to be lowered, and a rotary drum shear whose vertically-arranged axes allow the strand to be lowered between the knifes fixed onto the drums.

Once a reached meallurgical quality of the continuously cast strand has been reached, the rotary shear is stopped and the strand can then be directed to the rolling mill in which it is engaged in order to undergo successive continuous rolling operations, for example for the production of wire.

The operations of introducing the continuously cast strand into the shearing device and into the rolling mill are generally performed manually by operators who seize the strand with tongs as it leaves the casting wheel and guide it over the top of the wheel in order to introduce it into the shearing device or rolling mill located on the side facing the output of the wheel.

In a general way, since the curvature of the strand at the moment it leaves the wheel is the same as that of the wheel itself, the strand moves away from the extraction zone following a naturally curved path. The operator seizes the tip of the strand, makes it turn around the wheel and directs it to the input of the processing installation. Although the operator follows as much as possible the natural path of the strand, this maneuver calls for a fair amount of physical strength because of the stiffness of the strand, and for some alloys several operators must be present.

In addition, because the shearing machine and rolling mill are located a certain distance from the wheel, the weight of the strand over its path from the wheel to the shears becomes fairly substantial. A support table is therefore placed upstream of the shears to form a rolling path on which the strand can rest. The strand may also become tensioned as it passes through the pinching rollers, and so to prevent it from flattening against the casting wheel, the rolling path is extended up to above the wheel following a profile corresponding to the path naturally taken by the strand as it leaves the wheel.

Clearly such a maneuver is not without risk for operators.

SUMMARY OF THE INVENTION

The object of the invention is an arrangement for automatically guiding the strand without manual intervention from the point at which it leaves the casting wheel up to the shearing assembly, and consequently at lower cost and without placing operators at risk.

In addition, this guiding must be achieved in such a way as to not impede the strand as it emerges from the casting wheel, and without altering the strand metallurgical qualities.

The invention therefore relates to a device for guiding a cast bar or strand, continuously produced by casting over a section of the periphery of a casting wheel driven in rotation, between a molten metal pouring zone and a zone where the strand is extracted, and comprises a support table extending between the casting wheel and the input of an installation for processing the strand, said table passing underneath said entry point.

In accordance with the invention, at least a first section of the support table, extending from the extraction zone of the casting wheel up to above this casting wheel, is associated with external strand guide means that determine the progressive bending of the strand as it advances. These guide means and the first section of the support table respectively form an outer face and an inner face of a closed channel for guiding the strand, connecting tangentially to a second section of the support table extending towards the input of the processing installation.

However, the profile of such a guide channel cannot correspond in all cases to the path followed naturally by the strand, since this path can vary according to many factors such as the nature of the metal, cooling conditions, speed of rotation of the casting wheel, etc.

In particular, for some relatively hard alloys, the strand tends to move rapidly away from the wheel in a substantially straight line with a risk of its upstream section hitting the outer guide face.

The invention makes it possible to guide the strand along a path that is not necessarily the strand natural path, by progressively bending the strand as it advances. Excessive friction must be avoided since this can generate longitudinal stress in the solidified metal which could be transmitted to the extraction zone causing a reduction in speed and the risk of metal overflow.

The invention avoid these risks by bending the strand in several stages.

According to an essential characteristic of the invention, the outer means for guiding the strand comprise at least two successive guide tables, namely, a first table fixed substantially parallel to the path taken naturally by the strand immediately after it has been extracted from the casting wheel, and at least one movable table placed in the prolongation of the fixed table, the movable table being associated with means for adjusting its angular position between at least two positions in relation to the said fixed table, namely, an open position in which the downstream (in relation to the strand feed direction) end of the movable table is located substantially on the path taken naturally by the upstream section of the strand after it leaves the preceding fixed table, and a closed position in which the movable table connects tangentially, at its upstream end, to the downstream end of the preceding fixed table so that they jointly form an incurved outer guide surface.

The second guide table is initially open in a position corresponding to the natural path of the strand and does not therefore oppose the forward movement of the strand upstream section. Once the tip of the strand has passed the downstream end of the second table, the latter can be turned inwardly so as to determine a curve for the strand, this being effected in a zone remote from the side of the fixed table and sufficiently far from the upstream end of the strand to not slow its forward movement. Likewise, after bending, the strand can press against the entire length of the two successive tables, which can therefore be fitted with anti-friction rollers in order to reduce friction which is moreover distributed over a long length and therefore does not risk causing any appreciable longitudinal stresses in the product.

The same process can be performed by a third table which is also movable between an open position and a closed position.

These arrangements can advantageously be supplemented by one or more of the following features:

(a) the outer guide means comprise several successive tables each defining a portion of channel, respectively, a first fixed table and at least two movable tables capable of assuming various relative positions which allow them to jointly define a channel of smaller or larger general curvature;

(b) the tables defining the guide channel are articulated on each other;

(c) each mobile table has an integral arm forming a lever, a jack being articulated, on the one hand, on the end of this lever, and on the other hand, on the table preceding the table integral with the lever in the articulation chain of the tables forming the guide channel;

(d) the portion of the channel defined on a table is curved, and, when all the tables are closed on the casting wheel, they define a continuously curved channel whose downstream end is directed towards the input of the processing installation;

(e) the mechanical means defining the guide channel comprise anti-friction rollers which are regularly distributed along the bottom of the channel;

(f) immediately in front of the input to the rolling mill, the installation comprises means for seizing and guiding the strand arriving on the rolling mill up to the input of the rolling mill;

(g) the said means for seizing and guiding the strand immediately upstream of the input to the rolling mill comprise a lower table and an upper table of concave external shape, the upper table being articulated so as to pivot with respect no a frame that is itself fixed with respect to the lower table, the means comprising means for controlling the displacement of the upper table between an open position in which the upper table and lower table mutually define a large opening, and a closed position in which the upper table pushes the strand against the lower table.

BRIEF DESCRIPTION OF THE DRAWINGS

The following description is purely illustrative and must be read in conjunction with the attached drawings, in which.

DESCRIPTION OF THE PREFERRED EMBODIMENTS

Figure 1:
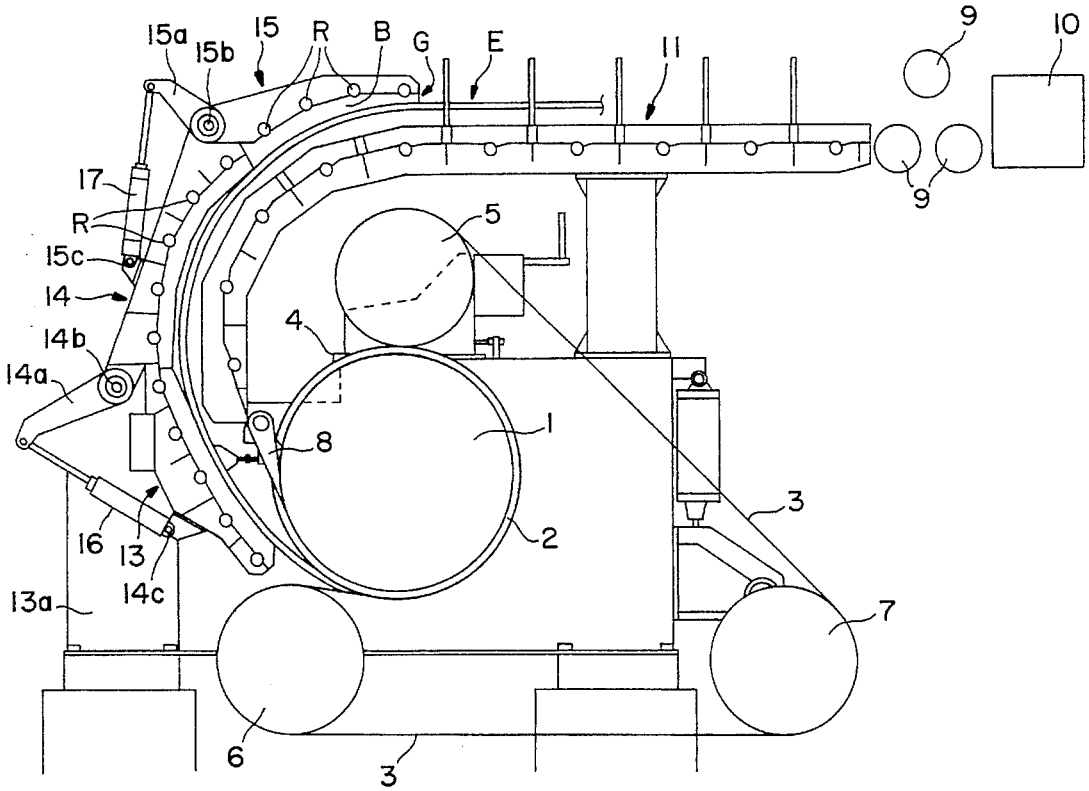
FIG. 1 is a schematic elevation of a first section of casting machine fitted with an automatic guide device in accordance with the invention.

FIG. 1 schematically shows a casting machine fitted with a guide device according to the invention, comprising a casting wheel 1 which has a groove 2 of trapezoidal cross-section, the casting wheel being covered by a metal strip 3 over approximately half of its periphery. Groove 2 and strip 3 thus form a mold in which the metal will be poured.

A feed chute 4 supplying molten metal is arranged at the upper section of wheel 1 on its upstream side in relation to its direction of rotation, emerges substantially at the level of the zone of wheel 1 where the metal strip 3 comes into contact with its periphery. This chute 4 is used to feed molten metal into the input of the mold.

Strip 3 is a closed strip which partially covers the periphery of wheel 1. The strip is pressed against the periphery of wheel 1 by a pressure wheel 5 and passes around two return wheels 6 and 7. Pressure wheel 5 is substantially tangent to the outer periphery of casting groove 2. It is arranged at the upper section of wheel 1, substantially at the level of and slightly downstream of feed chute 4 in relation to the direction of rotation of pressure wheel 5 which presses strip 3 against casting wheel 1. Return wheel 6 is arranged on the other side of casting wheel 1. Strip 3 passes onto wheel 6 at the output of the mold. The return plane of strip 3, tangential to both wheel 1 and wheel 6, is substantially horizontal. On leaving wheel 6, strip 3 passes around wheel 7 and then around pressure wheel 5. The axes of return wheels 6 and 7 are arranged substantially in the same horizontal plane. The tension of metal strip 3 can be maintained by adjusting the position of return wheel 7 in a manner known per se.

An extractor 8 is arranged in contact with the section of the periphery of wheel 1 that is not surrounded by strip 3, immediately beyond the zone where the strip separates tangentially from wheel 1. This extractor 8 is designed to take off the cast strand, referenced E in the drawings, from wheel 1 and groove 2.

The point at which the strand unsticks from the wheel and the path it takes at this point depend on the nature of the metal, temperature and casting conditions. It can be noted, however, that the path taken naturally by the strand when it takes off from the wheel is generally in the form of an involute to a circle.

After leaving the casting wheel, strand E must be introduced into a processing installation comprising, for example, a rolling mill 12 preceded by a shearing assembly 9,10.

As mentioned above, a support table 11 is generally placed upstream of shearing assembly 9 to support the strand up to the point it enters the processing installation and to prevent it from returning toward the casting wheel, for example as a result of being brought under tension. Table 11 extends between casting wheel 1 and shearing assembly 9 below the path or the strand, comprises a first portion 11*a* which partially surrounds the casting wheel starting from extraction zone 8, and is prolonged in the downstream direction by a second portion 11*b*.

The guide device is made up of a series of guide tables arranged in sequence, for example three tables 13, 14 and 15. These three tables all have a shape which is inwardly curved toward the side of the casting machine. Table 13 is fixed with respect to the frame of the casting machine and is mounted, for example, on a vertical chassis 13*a*. Its lower end is arranged between extractor 8 and return wheel 6 close the region of the zone where strand E takes off from wheel 1, i.e., at the Level of extractor 8 or possibly closer or further away from this point, depending on the nature of the metal.

This fixed table 13 supports the two other tables 14 and 15 which are movable with respect to the frame of the machine. At its upstream end, (in relation to the feed direction of strand E), table 14, or intermediate table, is articulated about a pivot axis 14*b* on the downstream end of table 13, i.e., the end of table 13 furthest from the unsticking zone. Pivot axis 14*b* is parallel to the axis of casting wheel 1. Table 14 is prolonged on the other side of axis 14*b* by an arm controlling the pivoting of axis 14*b*, and extending outwardly from the casting machine. The end of this pivoting control arm spaced from table 14 is articulated on the end of the rod of a jack 16 whose body is itself articulated on an anchoring point 14*c* arranged on a median section of table 13 towards the bottom of table 13.

In the same way, the third table 15, or movable end table, is mounted in articulated fashion so as to pivot about an axis 15*b* on intermediate table 14, and more precisely on the end downstream of the end opposite table 13. This table 15 is prolonged by an arm forming lever 15*a* similar to arm 14*a* and which extends outwardly from articulation axis 15*b*. The end of arm 15*a* farthest from table 15 is articulated on the rod of a jack 17 whose body is itself articulated about an axis 15*c* on a central section of table 14.

The three tables 13, 14 and 15 are formed in a similar way. Each comprises a steel welded chassis on which a series of anti-friction rollers R is mounted. On each table 13, 14, 15, these rollers define a guide surface which is curved inwardly towards the machine, and which is limited on either side of rollers R by two lateral edges B such that each table 13, 14, 15 forms a portion of channel G of U-shaped cross-section open on the side of wheel 1.

The channel defined by the tables for strand E leaving casting wheel 1 will be more or less inwardly curved depending on the positions of jacks 16 and 17. In the closed position shown in FIG. 1, tables 13, 14 and 15 are arranged in such a way that the inwardly curved surfaces defined by the rollers connect tangentially, the curvature of the channel being substantially continuous from the lower end of table 1.3 to the upper end of table 15, from where strand E leaves table 15 substantially horizontally.

Figure 3:
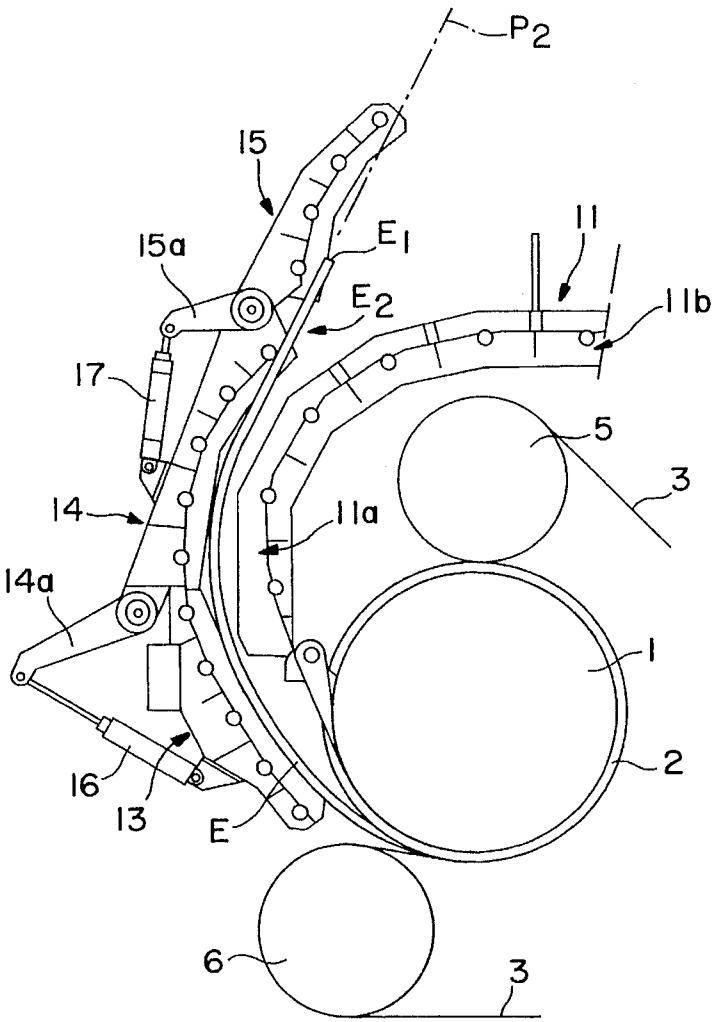
FIGS. 2 and 3 are partial schematic elevations of the casting machine shown in FIG. 1 and of the guide device, in different stages of operation of the device.
Figure 2:
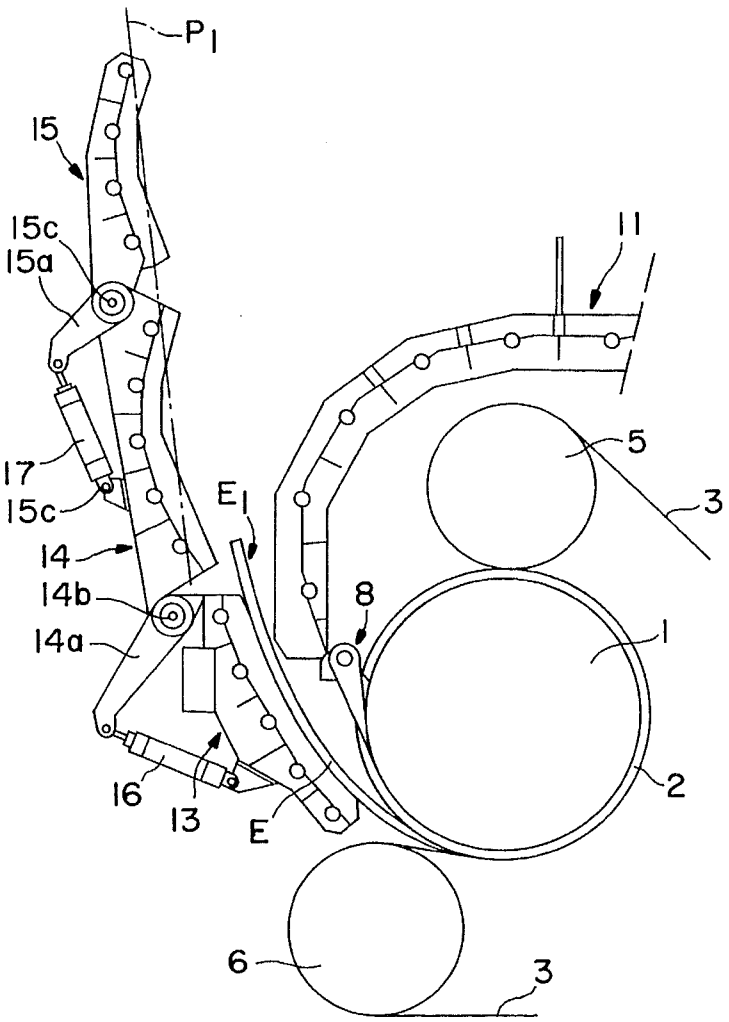

In the open position, the upstream and downstream end rollers of each mobile table 14, 15 define a plane substantially parallel to the plane tangent to the guide surface of the preceding table at its downstream end, all the other rollers being offset outside of this plane. Thus, in the case of FIG. 2, the end rollers of table 14 define a plane P1 directed along the tangent to the output of table 13. In the case of FIG. 3, the outer rollers of table 15 define a plane P2 parallel to the tangent to the output of table 14 in the closed position.

In their closed position, guide tables 13, 14, 15 therefore determine an outer guide face, inwardly curved along a curve parallel to the first section 11*a* of the transfer table, which thus closes towards the inside of guide channel G, and whose curvature can also be more accentuated than that of the path taken naturally by the strand for certain alloys when manually transferred. The first section 11*a* of the transfer table can therefore be closer to the casting wheel than in prior art installations, with closed channel C connecting tangentially to the second section 11*b* of the support table 11 which is directed towards the sharing assembly 9, 10.

Figure 4:
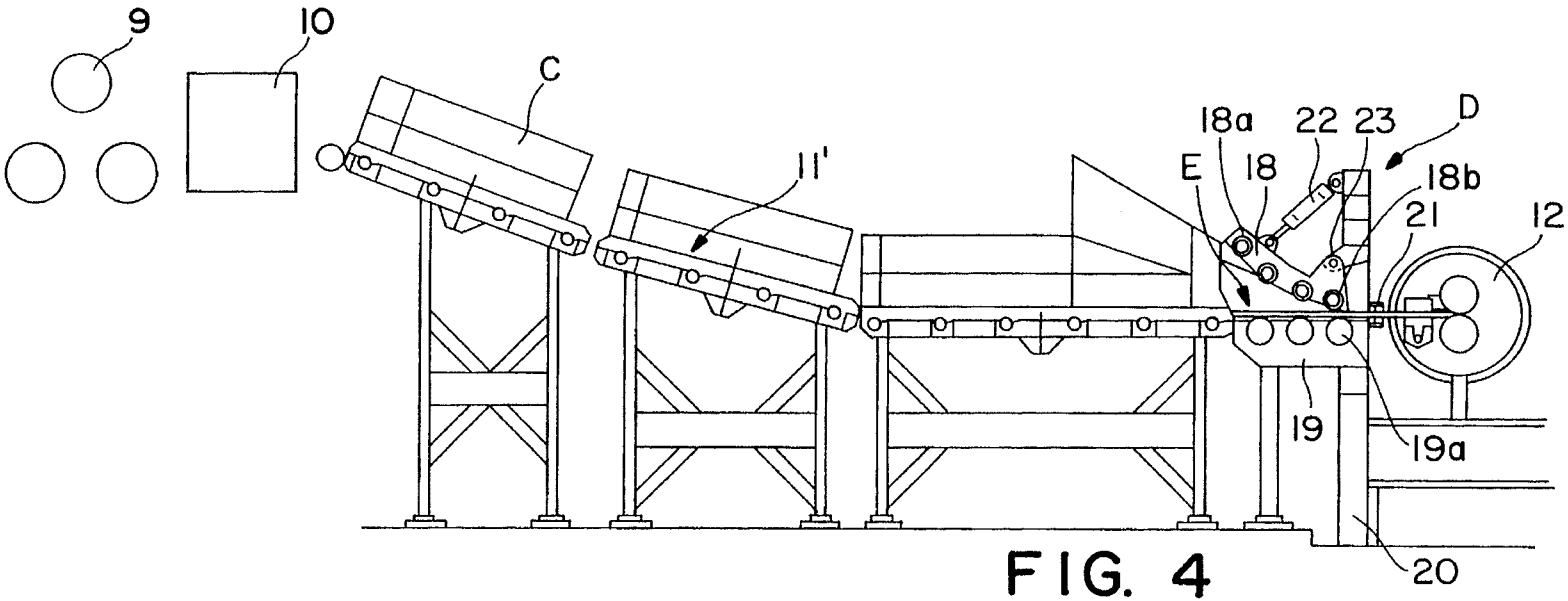
FIG. 4 is a schematic elevation of the second section of the same device.

Reference will now be made more particularly to FIG. 4, which shows the section of the installation downstream of shearing assembly 9, 10. The support table for strand E is prolonged by a transfer table 11' up to a device D designed, for example, to engage strand E in a rolling mill 12. This portion of table 11' is associated with guide means C. Device D mainly comprises a lower table 19 and an upper table 18 which are mounted on a support frame 20. The input to the rolling mill is traditionally fitted with a roller guide 21. Lower table 19 is made from welded steel and comprises a series of smooth roller wheels 19*a* with parallel axes, at least one of which is driven in rotation about its axis by a motor, via a free-wheel coupling and pinion cage (not shown). Upper table 18 is also made from welded steel and comprises a number of idler rollers 18*a* with parallel axes, arranged along a curved surface convex to the support table so as to form a guide space enlarged on the side that receives strand E arriving from transfer table 11', and which becomes progressively narrower towards input rollers 21. Table 18 can swing about an articulation axis 23 arranged above rollers 18*a* at the end of support frame 20 and which faces the input of rolling mill 12. A jack 22 bearing on the upper part of frame 20 is articulated towards the end of table 18 facing channel 11, and is used to swing table 18 about its axis 23, rollers 18*a* taking up the position shown in FIG. 5.

Figure 5:
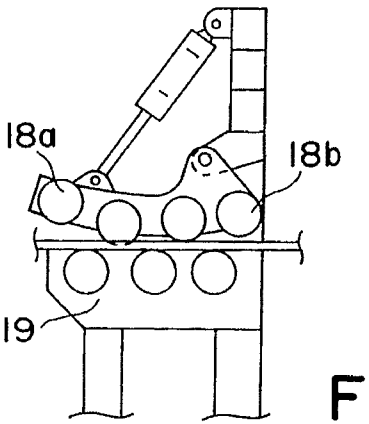
FIG. 5 is a detailed, large-scale elevation of the device for engaging the strand.

When table 18*a* is in the open position, the roller 18*b* at its downstream end is vertically aligned with articulation axis 23 and cooperates with the last roller wheel 19*a* of lower table 19 to pinch the end of the strand when it arrives and to direct it towards input rollers 21. Jack 22 then pivots upper table 18 causing downstream roller 18*b* to rise, as shown in FIG. 5. The other rollers of upper table 18 are arranged so as to take up position between the rollers of lower table 19. The strip therefore undergoes an aligning action when it engages in rolling mill 12.

The operation of the device will now be described. At the time casting begins, tables 14 and 15 are both in the open position shown in FIG. 2, jacks 16 and 17 being retracted. When the tip of strand E arrives at the level of extractor 8, it detaches from groove 2 of casting wheel 1 and moves towards table 13, following the curved profile of table 13 which corresponds substantially to the path taken naturally by he strand. At the output of table 13, the strand tends to continue tangentially along a substantially straight line parallel to plane P1, traveling upwardly along the first movable table 14, the assembly now being in the open position. When the tip of strand E reaches the upper end of movable table 14, the operator swings the table inwardly (FIG. 3). Strand E is now trapped between the ramp formed by the support table 11 and intermediate table 14. It continues its forward movement while maintaining on the inside of tables 13 and 14 the curvature which it has thus been given. Starting from the upper end of movable table 14, the strand is no longer guided, and for as long as the weight of the upstream part, considering its stiffness, is insufficient to make it bend, the upstream part continues its forward movement in a more or less straight line tangent to the curve formed by table 14 closed in order to move up along movable table 15 which is now in the open position. When the tip of strand E reaches the level of the last roller of movable table 15, table 15 is folded inwardly to the position shown in FIG. 1. Strand E is then completely trapped in closed channel G delimited on the outer side by successive tables 13, 14 and 15, and on the inner side by support table 11. It leaves the guide channel G thus defined and passes onto the second section 11*b* of support table 11 which follows a substantially horizontal or slightly inclined direction, allowing easy and immediate engagement in the roller-pincher shear assembly 9, 10.

By folding movable tables 14 and 15 after the tip of the strand has passed, it is possible to curve the strand without subjecting it to longitudinal stresses, the curving being effected by a given lever arm and applied on a zone away from the tip. This avoids any holding back of the forward movement of the solidified part of the metal.

The emergence of the strand along a horizontal or slightly inclined plane makes it easier to engage the strand in the pincher-shear assembly, and avoids having to engage the strand from above, which is always a difficult operation.

Rollers-pinchers 9, which are initially spaced from the zone through which the strand must pass, close on the tip of the strand when it arrives at their level, shear 10 then starting up. Once the metallurgical quality of the strand is satisfactory, rotary shear 10 is stopped, and strand 4 is sent via transfer table 11' to device D designed to engage the strand in rolling mill 12. Upper table 18 is initially in the wide open position represented in FIG. 4 by a solid line. Rollers 19*a* on the lower table are driven in rotation in the feed direction of strand E. Once strand E is engaged in the opening of device D, jack 22 closes upper table 18 onto lower table 19, causing lower table 19 to swing about its articulation axis 23.

This rotation of table 18 is controlled at a speed corresponding to the speed of strand E, in such a way that, through the progressive action of jack 22, rollers 18 come into contact with strand 3 sequentially and straighten the tip of the strand so as to facilitate its engagement in rolling mill 12, rollers 18*a* being positioned so as to form a line substantially tangential to the horizontal plane and separated from table 19 by a height substantially corresponding to the thickness of strand E. Strand E is therefore progressively guided between tables and 19 up to input rollers 21 of rolling mill 12.

In addition, when upper table 18 is open, the most downstream roller 18*b* is vertically in line with axis of rotation 23. Roller 18*b* therefore rises slightly when upper table 18 closes. This vertical position of roller 18*b* makes it possible to tangentially push the tip of the strand on engagement and then release it when it arrives at roller wheels 21 for lateral centering along the rolling axis. This release provides the possibility of repositioning the strand, as the case may be, at the time of its engagement.

All the arrangements described above therefore allow a reduction to be made in the number of operators required to engage the beginning of a casting machine and remove danger from the operation.

However, the two parts of the invention, namely, the progressively curved guide channel 13, 14, 15 and the engagement table 18 each have their own specific advantages and could therfore be advantageously used separately. For example, for modifications made to an existing installation, it could suffice to automate the guiding of the strand around the casting wheel.

What is claimed:

1. In a casting installation including a casting wheel (1) driven in rotation and comprising a peripheral groove (2) associated with a strip (3) covering a part of said periphery of said casting wheel between means (4) for pouring a molten metal forming a cast strand in said groove (2) and means (8) for extracting said cast strand (E), and a support table (11) for supporting said strand (E) up to a processing installation (12), said support table comprising a first portion (11*a*) partially surrounding said casting wheel (1) from said extraction means (8) and connecting tangentially to a second portion (11*b*) of said support table extending toward said processing installation (12) in a substantially straight direction, the improvement comprising:

a guiding device for guiding a cast bar or strand continuously produced in said casting installation between said casting wheel and a strand processing installation, said guiding device comprising outer guiding means (13, 14, 15) with said first portion (11*a*) of said support table (11) associated for guiding and progressively bending said strand (E) as it advances, said outer guiding means comprising at least two successive guide tables, namely, a first table (13) fixed substantially parallel to a path taken by said strand (E) immediately after it has been extracted from said casting wheel (1), and at least one movable table (14) placed in a prolongation of said fixed table (13) and having an upstream end and a downstream end, said at least one movable table (14) being associated with means for adjusting its angular position between at least two positions in relation to said fixed table (13), namely, an open position in which said downstream end of said at least one movable table (14) is located substantially on the path taken by an upstream section of said strand (E) after it leaves said fixed table (13), and a closed position in which said upstream end of said at least one movable table (14) connects tangentially to a downstream end of said fixed table to jointly form together a curved outer guide surface connecting tangentially to the direction of said second portion (11*b*) of said support table (11), said at least two guide tables (13, 14, 15) defining, in their closed position and with said first portion (11*a*) of said support table (11), respectively, an outer face and an inner face of a closed channel (G) for guiding said strand (E) toward said second portion (11*b*) of said support table (11).

2. The casting installation of claim 1, wherein said outer guiding means comprises tables each defining a portion of said closed channel, respectively, said first fixed table and at least two articulated movable tables being capable of assuming various relative positions which allow them to jointly define a channel of varying curvature.

3. The casting installation of claim 1 or 2, wherein said guide tables defining said closed channel are articulated on each other.

4. The casting installation of claim 3, wherein said at least one movable table is integral in rotation with a lever arm on which an element of a cylinder is articulated, and whose other element is articulated on the table upstream of said table integral with said lever arm in the sequence of tables forming said closed channel.

5. The casting installation of claim 1 or 2, wherein each of said tables comprises an inwardly curved guide surface, respective guide surfaces of said tables connecting tangentially in closed position to define an outer face of said channel having a continuous curvature.

6. The casting installation claim 1 or 2, wherein said closed channel is defined by mechanical means comprising anti-friction rollers which are evenly distributed along a bottom of said closed channel.

* * * * *